United States Patent [19]

Williams, Sr.

[11] 4,355,811

[45] Oct. 26, 1982

[54] AUTOMATIC GOLF BALL TEEING APPARATUS

[76] Inventor: Louis E. Williams, Sr., P.O. Box 4216, Columbia, S.C. 29240

[21] Appl. No.: 182,092

[22] Filed: Aug. 28, 1980

[51] Int. Cl.[3] ..... A63B 57/00

[52] U.S. Cl. ..... 273/201

[58] Field of Search ..... 273/201, 33; 74/89.15

[56] References Cited

U.S. PATENT DOCUMENTS

| | | | |
|---|---|---|---|
| 1,637,537 | 8/1927 | Roberts . | |
| 2,295,599 | 9/1942 | Mozel | 273/201 |
| 2,643,883 | 6/1953 | Hogeberg | 273/33 |
| 2,696,985 | 12/1954 | Hogeberg | 273/201 |
| 2,711,321 | 6/1955 | McGraw, Sr. | 273/201 |
| 3,298,694 | 1/1967 | Turnau et al. | 273/201 |
| 3,378,263 | 4/1968 | Turnau | 273/201 |
| 3,448,985 | 6/1969 | Scott | 273/201 |
| 3,533,631 | 10/1970 | Hladek | 273/201 |
| 3,738,663 | 6/1973 | Gentiluomo | 221/9 |
| 3,778,067 | 12/1973 | Gentiluomo | 273/201 |
| 3,966,213 | 6/1976 | Bradley | 124/50 |
| 4,017,087 | 4/1977 | Bruno | 273/201 |
| 4,022,076 | 5/1977 | Metz | 74/89.15 |

*Primary Examiner*—Richard C. Pinkham

*Assistant Examiner*—T. Brown

*Attorney, Agent, or Firm*—Benoni O. Reynolds

[57] ABSTRACT

A golf ball teeing apparatus which utilizes a double-threaded shaft and its attendant pawl assembly as a mechanism to elevate replacement golf balls sequentially from a supply tube and hopper to a driving position, automatically, as the tee element and prior golf ball are struck by the golfer. When struck by a golf club, the spring-loaded tee element tilts forward causing the lower curved end of the tee element to strike a pressure-sensitive microswitch which, in turn, closes a holding relay actuating the fractional horsepower electrical motor for an operating cycle. The geared-down fractional horsepower motor slowly rotates the double-threaded shaft to which it is coupled, thereby lowering the pawl assembly and the piston supporting the tee assembly to the ball receiving position. At that point in the cycle, a golf ball is fed by gravity from a supply tube and nearby hopper onto the tee element. Then, in one continuous motion, the reverse thread of the rotating double-threaded shaft raises the pawl assembly, piston and tee assembly back up to the fully teed-up or driving position where a second microswitch is struck by a pin on the pawl assembly, opening the holding relay and stopping the fractional horsepower motor.

1 Claim, 6 Drawing Figures

AUTOMATIC GOLF BALL TEEING APPARATUS

BACKGROUND OF THE INVENTION (1) Field of Invention

This invention relates to apparatus for automatically teeing golf balls and is especially suited for golf driving ranges and practice tees at public or private golf courses (2) Description of Prior Art Most golf ranges and golf courses do not have apparatus for presenting golf balls automatically to the practicing golfer so the must stop between strokes to place a new ball on the tee. This action usually involves stooping over to place a golf ball on a prepared tee or inserting a tee into the ground and placing the new ball onto the tee. This is a laborious process and disconcerts the golfer from concentrating on his stance, grip and swing.

Various forms of apparatus for the same purpose are known in the art but such devices are generally of complicated construction, difficult and expensive to install, have low reliability in operation and require frequent maintenance. Also some of these devices are not automatic but require manual activation by the golfer. Other devices are so sophisticated electronically that they would be impractical for general usage on public ranges or for practice tees which have limited use. Prior art known to this inventor includes the following U.S. Pat. Numbers:

U.S. Pat. No. 1,637,537, 8/1972, Roberts
U.S. Pat. No. 2,643,883, 6/1953, Hogeberg
U.S. Pat. No. 2,696,985, 12/1954, Hogeberg
U.S. Pat. No. 3,298,694, 1/1967, Turnau
U.S. Pat. No. 3,378,263, 4/1968, Turnau
U.S. Pat. No. 3,533,631, 10/1970, Hladek
U.S. Pat. No. 3,738,663, 6/1973, Gentiluomo
U.S. Pat. No. 3,778, 067, 12/1973, Gentiluomo
U.S. Pat. No. 3,996,213, 6/1976, Bradley
U.S. Pat. No. 4,017,087, 4/1977, Bruno

BRIEF SUMMARY OF THE INVENTION

The present invention is an automatic golf ball teeing apparatus in which the replenishment operation is initiated by the act of the golfer stroking the golf ball from the tee element. Thus, the replenishment operation does not require the golfer to remove his hands from the golf club or otherwise be distracted from concentration on his stance, grip and swing. Because of the few, simple components of the present invention, it is easily and inexpensively manufactured, reliable in operation and easily maintained. Because its configuration is compact and self-contained, the device is easily installed and easily removed for maintenance.

According to the preferred embodiment of this invention, the operative components are mounted on a base and the entire unit is enclosed in a protective housing which slips over the unit and is fastened in place by access screws. The top of the protective housing also serves as the teeing platform which is covered with a layer of resilient matting of optional thickness to protect the head of the golf club and to control the depth of the golf stroke.

A ball guide, which is mounted vertically on the base, encloses a supporting piston and tee assembly which can move freely up and down within the ball guide. A double-threaded shaft is mounted parallel and in close proximity to the ball guide with the lower end of the shaft coupled to a gear reduction box and the upper end of the shaft coupled to a lifting assembly. The lifting assembly consists of a lift housing which encloses a cap, pawl and retaining spring which causes the pawl to mesh with the threads of the double-threaded shaft. The lift housing has a lifting pin extension which couples the supporting piston with the lifting assembly through a long vertical slot in the side of the ball guide. The tee assembly is self-contained and is mounted atop the supporting piston and moves with it as a unit. The tee assembly consists of a pivotally mounted tee element, concave at the top, slightly curved at the lower end and spring-loaded in a generally upright position. The tee element is mounted in such a position that when struck by a golf club the curved end of the element passes through an opening provided in the side of the ball guide and presses against the actuating arm of a starting microswitch mounted on the outside of the ball guide. A stopping microswitch is likewise mounted on the outside of the ball guide positioned so the actuating arm of the switch is depressed when the lifting pin extension strikes the arm on the uppermost travel of the pin. Both microswitches are electrically connected to a holding relay which closes during the replenishment cycle and releases at the end of the cycle, turning off the fractional horsepower electrical motor mounted on the base. This motor is coupled to the lower end of the double-threaded shaft by means of the gear reduction box.

When struck by the golf club, the tilted tee element depresses the starting microswitch, the holding relay closes and the fractional horsepower motor starts a cycle. The coupling reduction gear rotates the double-threaded shaft lowering the lifting assembly and supporting piston to the ball receiving position just below the supply tube opening in the side of the ball guide. After the tee element receives a new golf ball which is gravity fed down the supply tube from the hopper, the rotating double-threaded shaft, in one continuous movement, causes the lifting assembly, the supporting piston and the tee assembly to return to their initial fully teed-up or driving position. At that point the stopping microswitch is activated by the lifting pin extension, releasing the holding relay and turning off the fractional horsepower motor.

OBJECTIVES OF THE INVENTION

The objectives of the present invention are to provide a golf ball teeing apparatus for general use on golf ranges or golf practice tees which is:

(1) fully automatic in operation, requiring no distracting movement of the golfer to replenish the tee;
(2) more simple and inexpensive to manufacture than devices known in prior art designed to perform the same function;
(3) compact in size and unitary in design to permit less costly installation and maintenance;
(4) constructed with fewer moving parts and with a more positive and dependable lifting device, thereby providing more reliable operation and less maintenance under heavy usage conditions.

Other objectives and advantages of the present invention will be apparent during the course of the following detailed description.

DETAILED DESCRIPTION OF THE PREFERRED EMBODIMENT OF THE INVENTION

Figure 1:
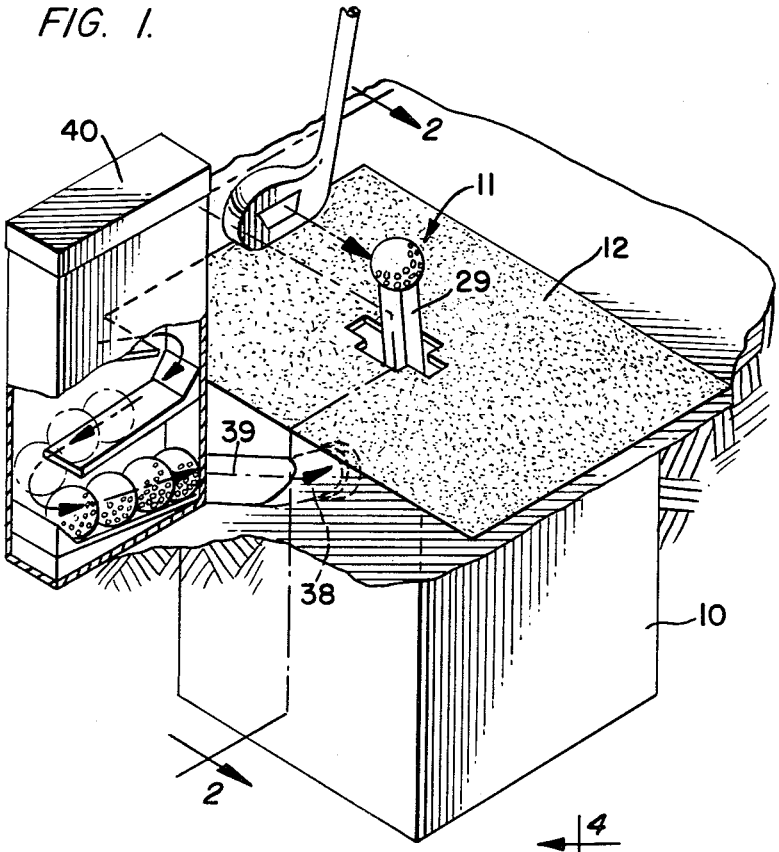
FIG. 1 is a perspective view from the left front of an automatic golf ball teeing apparatus constructed in accordance with the principles of the present invention, showing the outside protective housing, the teeing platform, the upper portion of the tee element and the ball supply hopper.
Figure 3:
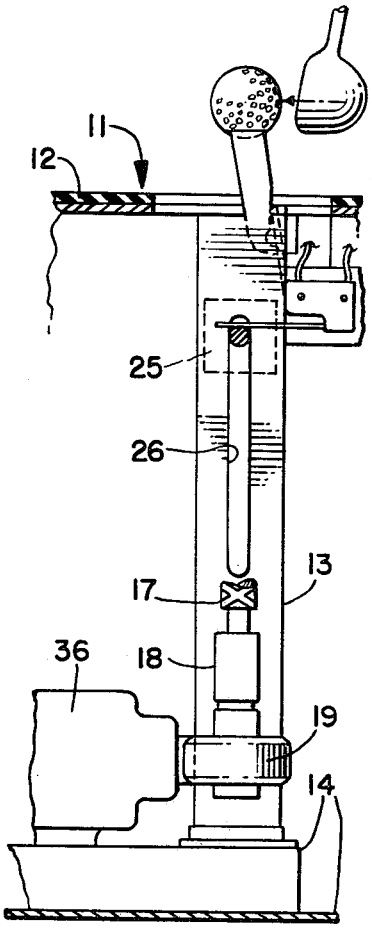
FIG. 3 is a fragmentary side elevational view of the ball guide of the present invention taken substantially along line 3—3 of FIG. 2 showing the long narrow slot in the side of the ball guide through which the lifting pin extension travels and showing the relationship of the lifting pin in its uppermost travel with the stopping microswitch.

The automatic golf ball teeing apparatus is a compact, relatively small unit, which in its best mode of operation is easily and quickly installed at golf ranges, golf course practice tees or at any other suitable location a golfer may choose. Throughout the following detailed description of the present invention like reference numerals are used to denote like parts disclosed in the accompanying drawings, FIGS. 1-6. As shown in FIG. 1, the automatic golf ball teeing apparatus is designed so that its major components can be housed below ground level in a protective housing 10 or suspended from a platform, if necessary. Indicated generally by reference numeral 11 is the teeing platform which the the golfer addresses when stroking the golf ball. A resilient matting 12 which can be of various thicknesses, provides a scuff surface to protect the golf club head when hitting the golf ball and to control the depth of the golf stroke. The teeing platform 11 also serves as the cover for the protective housing 10 which encloses the components mounted beneath.

Figure 2:
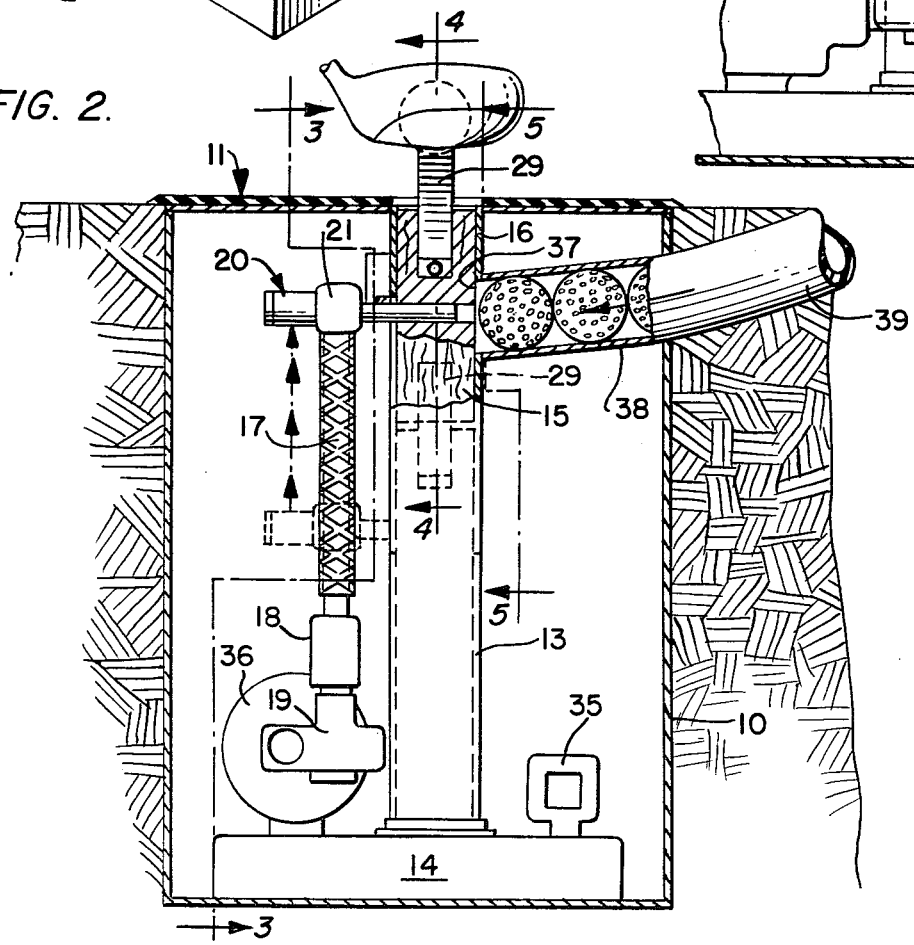
FIG. 2 is a rear sectional view of the same present invention taken substantially along line 2—2 in FIG. 1 looking in the direction of the arrows. Shown in full lines are the lifting assembly, the tee assembly and the supporting piston in their elevated or fully teed-up position. Shown in dashed lines are the same components in their lowered or ball receiving position.
Figure 4:
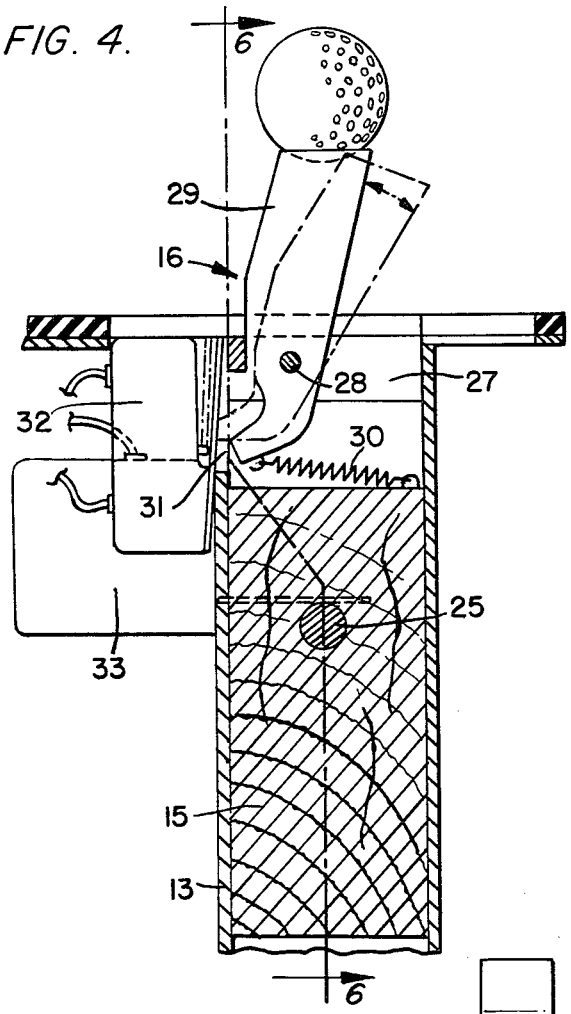
FIG. 4 is a fragmentary side sectional view of the present invention taken along line 4—4 of FIG. 2 from the direction of the arrows showing the details of the supporting piston and tee assembly as well as the location of the starting and stopping microswitches.
Figure 5:
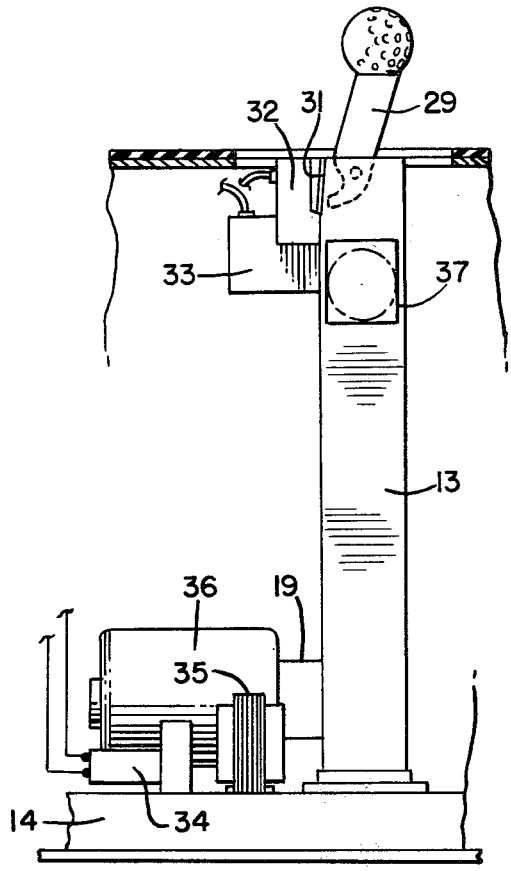
FIG. 5 is a side elevational view taken substantially along line 5—5 of FIG. 2 looking in the direction of the arrows showing the position of the supply tube opening provided in the side of the ball guide to permit the gravity feed of replenishment golf balls from the ball supply hopper. Also shown are the locations of the fractional horsepower electrical motor, the holding relay and the transformer which is a source of direct current for the relay.
Figure 6:
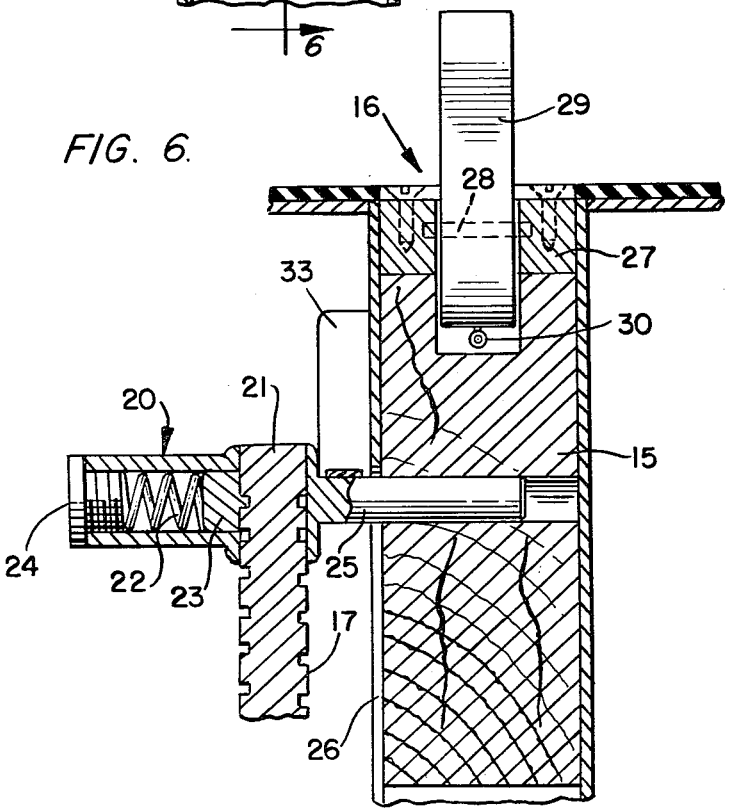
FIG. 6 is a fragmentary rear sectional view of the present invention taken substantially along line 6—6 of FIG. 4 showing the details of the lifting assembly (pawl not shown) and its relationship to the supporting piston, the tee assembly and the stopping microswitch in the elevated or fully teed-up position.

Secured to the underside of teeing platform 11 is a ball guide 13, shown best in FIGS. 2 and 5, which is vertically mounted on base 14. This ball guide 13 encloses a supporting piston 15 and a tee assembly 16 which are sized to move freely upwards and downwards within ball guide 13. Double-threaded shaft 17 is mounted parallel to and slightly to one side of ball guide 13 with the lower end of the shaft attached by coupling 18 to reduction gear box 19 and the upper end of the shaft coupled to lifting assembly indicated generally by reference numeral 20. Lifting assembly 20 consists of lift housing 21 which fits slidably over and around double-threaded shaft 17, retaining spring 22 which presses pawl 23 (not shown in lift housing) against the threads of the shaft, in a meshing relationship, and retaining cap 24 to retain spring 22 within lift housing 21. Extending from and as an integral part of lift housing 21 is lifting pin extesion 25 which inserts into supporting piston 15 through opening 26, a long, narrow, vertical slot provided in the side of ball guide 13 to permit the vertical travel of supporting piston 15 reciprocally within the guide while attached to lifting assembly 20.

Tee assembly 16 mounts atop supporting piston 15 and consists of tee mounting block 27, pivot pin 28 and tee element 29, the latter component being concave at the top to correspond to the curvature of a golf ball providing a steady pedestal. Tee element 29 is pivotally mounted and recessed in tee mounting block 27. Tension spring 30 connects the curved lower end of tee element 29 to the front side of supporting piston 15 to keep tee element 29 in an essentially upright position at times other than when struck by a golf club. The tee element 29 is mounted in such a position that when struck by a golf club, the curved lower end of the element passes through opening 31 provided in the side of ball guide 13 and presses against the actuating arm of starting microswitch 32 mounted on the exterior of ball guide 13 at its upper extremity. Stopping microswitch 33 is likewise mounted on the exterior of ball guide 13, just above lifting assembly 20 at its fully elevated position, and so oriented with respect to the top edge of lifting pin slot 26 that the actuating arm of the microswitch is depressed when lifting pin 25 strikes the arm on the uppermost travel of the pin. Both starting microswitch 32 and stopping microswitch 33 are connected electrically to a holding relay 34 which closes when activated by starting switch 32 and which releases when deactivated by stopping microswitch 33. Direct electrical current to operate the microswitches 32 and 33 and the holding relay 34 is supplied by conventional transformer 35 mounted on base 14 as shown in FIG. 5. Holding relay 34 closes and opens the electrical circuit which furnishes power to fractional horsepower motor 36 which also is mounted on base 14 near the lower end of double-threaded shaft 17 and coupled to the shaft by reduction gear box 19.

As best illustrated in FIG. 2, tee element 29, when struck by a golf club, activates starting microswitch 32 which in turn closes holding relay 34 and starts fractional horsepower motor 36. Fractional horsepower motor 36, through coupling reduction gear box 19, rotates the double-threaded shaft 17, lowering lifting assembly 20, supporting piston 15 and tee assembly 16 to the ball receiving position just below the supply tube opening 37. At that point a replenishment golf ball is fed by gravity from supply tube 38 and flexible hose 39 leading from ball supply hopper 40. After the tee element 29 has received the golf ball, the rotating double-threaded shaft 17 causes lifting assembly 20, supporting piston 15 and tee assembly 16 to return upward to their initial fully teed-up position. When lifting pin extension 25 reaches its uppermost limit of travel it activates stopping microswitch 33 releasing holding relay 34 turning off the power to geared-down fractional horsepower motor 36.

I claim:

1. In an automatic golf ball teeing apparatus having a tee assembly, including a tee mounting block and a tee element for holding a golf ball, said tee element being pivotally mounted on said tee mounting block and having a curved lower end, a supporting piston for carrying said tee assembly between an elevated fully teed-up position and a lowered ball-receiving position, means for maintaining said tee assembly and its supporting piston in an upright condition and permitting the movement of these components between an elevated fully teed-up position and a lowered ball-receiving position, elevating means for lowering said tee assembly and its supporting piston to a ball-receiving position and then returning said tee assembly and its said supporting piston to a fully teed-up position after receiving a replenishment golf ball, a control system operatively associated with said elevating means and said tee assembly to cause said elevating means to automatically lower said tee assembly and its said supporting piston to a ball receiving position, when said tee element is displaced about its pivot pin when struck by a golf club, and to return said tee assembly and its said supporting piston to a fully teed-up position after receiving a replenishment golf ball, and ball supply means communicating a gravitationally-fed supply of golf balls to said tee element, the improvement wherein the said means for maintaining said tee assembly and its said supporting piston in an upright condition comprises:

a ball guide which is hollow and vertically mounted, provided with a long, narrow, vertical slot in one side to permit said elevating means to attach to said tee assembly and its said supporting piston and permit the vertical movement of said elevating means with said tee assembly and its said supporting piston as a unit, and an opening in one side, near its upper end, sufficient in size to permit said curved lower end of said tee element, pivotally mounted above said supporting piston, to protrude through the side of said ball guide when said tee element is displaced about its pivot pin when struck by a golf club.

* * * * *